US007055765B2

(12) United States Patent
Liskow

(10) Patent No.: US 7,055,765 B2
(45) Date of Patent: Jun. 6, 2006

(54) FUEL INJECTION VALVE

(75) Inventor: Uwe Liskow, Asperg (DE)

(73) Assignee: Robert Bosch GmbH, Stuttgart (DE)

( * ) Notice: Subject to any disclaimer, the term of this patent is extended or adjusted under 35 U.S.C. 154(b) by 146 days.

(21) Appl. No.: 10/470,292

(22) PCT Filed: Oct. 1, 2002

(86) PCT No.: PCT/DE02/03714

§ 371 (c)(1),
(2), (4) Date: Jan. 14, 2004

(87) PCT Pub. No.: WO03/048559

PCT Pub. Date: Jun. 12, 2003

(65) Prior Publication Data

US 2004/0112992 A1 Jun. 17, 2004

(30) Foreign Application Priority Data

Nov. 30, 2001 (DE) ..... 101 58 789

(51) Int. Cl.

| | |
|---|---|
| ***B05B 1/30*** | (2006.01) |
| ***F02M 59/00*** | (2006.01) |
| ***F02M 61/00*** | (2006.01) |
| ***F02M 47/02*** | (2006.01) |

(52) U.S. Cl. ..... 239/585.1; 239/585.3; 239/585.5; 239/533.2; 239/533.8; 239/88

(58) Field of Classification Search .. 239/585.1–585.5, 239/533.1, 533.2, 533.8, 533.9, 88–93, 900; 251/129.15, 129.21, 127

See application file for complete search history.

(56) References Cited

U.S. PATENT DOCUMENTS

| | | | | |
|---|---|---|---|---|
| 5,979,803 | A * | 11/1999 | Peters et al. | 239/533.4 |
| 6,012,430 | A * | 1/2000 | Cooke | 123/467 |
| 6,155,532 | A | 12/2000 | Heinz et al. | |
| 6,328,017 | B1 * | 12/2001 | Heinz et al. | 123/467 |
| 6,340,121 | B1 * | 1/2002 | Lambert | 239/533.4 |

FOREIGN PATENT DOCUMENTS

| | | |
|---|---|---|
| DE | 30 30 378 | 2/1982 |
| DE | 195 00 706 | 7/1996 |
| DE | 1 079 099 | 2/2001 |
| DE | 199 40 056 | 3/2001 |
| DE | 199 40 055 | 4/2001 |
| DE | 199 53 562 | 5/2001 |
| DE | 100 07 733 | 8/2001 |
| DE | 100 07 735 | 8/2001 |
| EP | 0 477 400 | 4/1992 |

* cited by examiner

*Primary Examiner*—Davis Hwu
(74) *Attorney, Agent, or Firm*—Kenyon & Kenyon, LLP

(57) ABSTRACT

A fuel injector, in particular a fuel injector for fuel-injection systems of internal combustion engines, including a piezoelectric or magnetostrictive actuator, which, via a valve needle, actuates a valve-closure member arranged on the valve needle, the valve-closure member cooperating with a valve-seat surface to form a sealing seat, the fuel injector having an hydraulic compensation chamber. A pressure piston cooperates with the compensation chamber, which is filled with hydraulic fluid via an hydraulic fluid inlet. The actuator is arranged between the pressure piston and the valve needle and displaceable in the axis of the valve needle and the pressure piston.

16 Claims, 1 Drawing Sheet

FUEL INJECTION VALVE

FIELD OF THE INVENTION

The present invention relates to a fuel injector.

BACKGROUND INFORMATION

European Patent Application No. 0 477 400 A1 discusses a system for an adaptive mechanical tolerance compensation, which is effective in the lift direction and intended for a path transformer of a piezoelectric actuator for a fuel injector. In this case, the actuator acts on a master (transmitting) piston, which is connected to an hydraulic chamber, and a slave (receiving) piston, which moves a mass to be driven and positioned, is moved via the pressure increase in the hydraulic chamber. This mass to be driven is a valve needle of a fuel injector, for example. The hydraulic chamber is filled with an hydraulic fluid. When the actuator is deflected and the hydraulic fluid in the hydraulic chamber is compressed, a small portion of the hydraulic fluid leaks at a defined leakage rate. This hydraulic fluid is replenished in the rest phase of the actuator.

German Patent Application No. 195 00 706 A1 discusses an hydraulic path transformer for a piezoelectric actuator of a fuel injector, which is positioned between the actuator and a valve needle of the fuel injector. A master piston and a slave piston are arranged on a common axis of symmetry, and an hydraulic chamber lies between the two pistons. A spring, which presses the master cylinder and the slave piston apart, is located in the hydraulic chamber, the master piston being prestressed in the direction of the actuator and the slave piston in a working direction against a valve needle. When the actuator transmits a lifting movement to the master cylinder, this lifting movement is transmitted to the slave piston by the pressure of an hydraulic fluid in the hydraulic chamber, since the hydraulic fluid in the hydraulic chamber is not compressible and only a small portion of the hydraulic fluid is able to escape during the short duration of a lift through ring gaps between the master piston and a guide bore, and a slave piston and a guide bore.

In the rest phase, when the actuator does not exert any compressive force on the master cylinder, the master piston and the slave piston are pushed apart by the spring, and, due to the produced vacuum pressure, the hydraulic fluid enters the hydraulic chamber via the ring gaps and refills it. In this way, the path transformer automatically adapts to linear deformations and pressure-related expansions of a fuel injector.

Disadvantageous in this related art is that the path transformer gets very hot from the waste heat of an internal combustion engine. The path transformer is located in a region of the fuel injector that lies deep in an installation bore once the fuel injector is installed and thus in close proximity to the combustion chamber. In the rest phases of the actuator, the fuel may evaporate and thus cause a failure of the fuel injector, since the evaporated fuel is compressible and the valve needle is not opened for that reason.

This danger exists in particular after a hot internal combustion engine has been shut off. The fuel-injection system then loses its pressure, and the fuel evaporates particularly easily. This may have the result that in a renewed effort to start the internal combustion engine the lifting movement of the actuator is no longer transmitted to a valve needle and the fuel injector no longer functions.

SUMMARY OF THE INVENTION

In contrast, the fuel injector according to the present invention has the compensation chamber near a fuel-distributor line and at a distance from the side of the fuel injector contacting a combustion chamber of an internal combustion engine. The fuel injector according to an exemplary embodiment of the present invention thus has a lower temperature in the region of the compensation chamber than the related art. Furthermore, a larger unit volume is available for the compensation-chamber design.

In an exemplary embodiment of the present invention a chamber spring is located on the compensation-chamber side of the pressure piston and exerts a prestressing force on the pressure piston, which pushes the pressure piston out of the compensation chamber or out of a guide bore of the pressure piston connected to the compensation chamber. The chamber spring may be a membrane spring, a disk spring or a helical spring.

During the rest phase when no voltage is applied to the magnetostrictive or piezoelectrical actuator, the actuator does not exert any pressure on the pressure piston. Instead, because of the chamber spring, the pressure piston is pressed against the actuator, which is supported so as to be movable and displaceable and is advanced in the direction of the valve needle until is comes to rest against it. Due to the attendant volume increase of the compensation chamber, a vacuum pressure is produced and hydraulic fluid flows into the compensation chamber via the hydraulic fluid inlet until the vacuum pressure is compensated. In this manner, the loss of hydraulic fluid during the working phase of the actuator and the superpressure this produces is compensated. Linear deformations of the housing and the transmission path from the valve needle via the actuator up to the actuator support are thus compensated for, since the actuator is braced on the pressure piston, which always advances to the maximum extent in the direction of the valve needle.

In an exemplary embodiment of the present invention, the compensation chamber is also able to be supplied with an hydraulic fluid that is under a higher pressure than the pressure of the fuel on the actuator side of the pressure piston.

This exerts pressure on the pressure piston during the rest phases of the actuator, without a chamber spring being required, the force moving the pressure piston, and thereby the float-mounted actuator, toward the valve needle up to the stop. This also compensates for the leakage losses during the working phase of the actuator and for the linear deformations of the housing and the linear deformations of the actuator and the valve needle caused by the heating and fuel pressure during the rest phases of the actuator.

The hydraulic fluid inlet may have an intake throttle, which allows only a small portion of the compensation chamber volume of hydraulic fluid to flow back during activation of the actuator.

During the brief activation phase of the actuator, only little hydraulic fluid can drain and flow back, whereas during the long rest phase of the actuator sufficient hydraulic fluid is able to flow in to ensure a play compensation and to replenish the compensation chamber at all times.

The hydraulic fluid inlet may have a check valve, thereby allowing a particularly rapid replenishing during the rest phases. If the check valve is configured as a rapidly responding check valve, return-flow losses during the working phase of the actuator may effectively be prevented.

In an exemplary embodiment of the present invention, the hydraulic fluid inlet is a controllable intake valve, which is closed in the non-controlled state.

Since such an intake valve may release a large cross section, the compensation chamber may be filled very rapidly by a control pulse during the rest phase.

The compensation chamber may have an hydraulic fluid outlet with a discharge throttle. As in the case of the hydraulic fluid inlet, the loss during the control phase of the actuator and the attendant pressure increase is only slight; however, a continuous flushing of the compensation chamber and an advantageous cooling of the compensation chamber may occur during the rest phase of the actuator.

Alternatively, the compensation chamber has an hydraulic fluid outlet with a controllable discharge valve, which is closed in the non-controlled state in a preferred specific embodiment. In this way, an especially large cross section and increased flushing may be achieved during the rest phase.

As an alternative, the hydraulic fluid outlet of the compensation chamber may have a pressure limiting valve. By increasing the pressure above the limiting pressure of the pressure limiting valve a flushing may be achieved during the rest phase of the actuator. If the pressure limiting valve is designed in such a way that the response lag of the pressure limiting valve is greater than the time duration of a working phase of the actuator, hydraulic fluid losses during the working phase may be kept to a minimum.

In an exemplary embodiment of the fuel injector according to the present invention, the hydraulic fluid outlet in the compensation chamber is located at the highest point in the installation position of the fuel injector. In this way, any gas bubbles that may be present are removed during flushing. In particular during the start of an internal combustion engine, which was switched off earlier in a hot operating state, a functioning of the fuel injector may be ensured. Gas bubbles that may be produced by evaporating fuel and may prevent a pressure generation in the compensation chamber because of their compressibility, are removed in a reliable and rapid manner.

The compensation chamber may be filled with fuel, or may alternatively also be connected to an oil circuit of the internal combustion engine.

DETAILED DESCRIPTION

Figure 1:
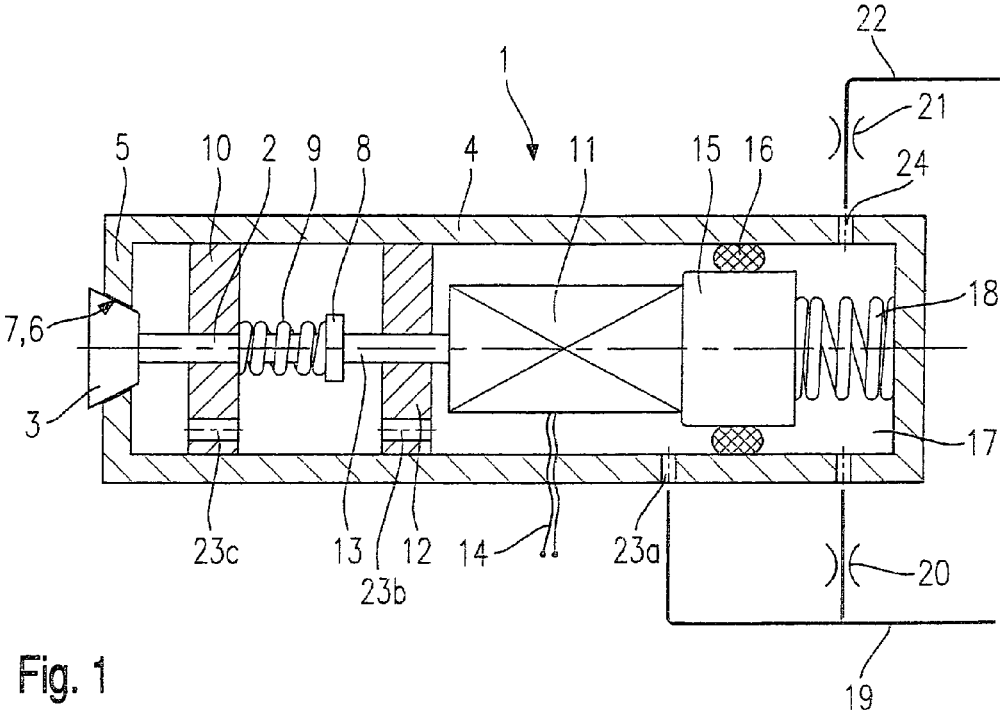
FIG. 1 shows a schematic section through a first exemplary embodiment of a fuel injector according to an exemplary embodiment of the present invention.

FIG. 1 schematically shows a fuel injector 1 in a section and a block diagram. It is a fuel injector 1 having an outwardly opening valve needle 2, which is connected to a valve-closure member 3. A valve-seat support 5, integrally formed or constructed with a valve body 4, has a valve-seat surface 6, which forms a sealing seat 7 together with valve-closure member 3. Valve needle 2 has a spring stop 8 on which valve needle 9 is braced. At its second end, valve spring 9 rests against a guide sleeve 10 for valve needle 2. Via spring stop 8, valve spring 9 exerts an initial stress on valve needle 2, which presses valve-closure member 3 against sealing seat 6.

An actuator 11 is connected to an actuator tappet 13 guided in a partition shield 12. Actuator 11 may be supplied with a current via connecting lines 14. At its end facing away from sealing seat 6, actuator 11 is connected to a pressure piston 15, which seals a compensation chamber 17 from valve body 4 by an elastic seal 16. The interconnected and cooperating unit made up of actuator tappet 13, actuator 11 and pressure piston 15 is supported in a moveable and float-mounted manner in the longitudinal axis of fuel injector 1 by partition disk 12 via actuator tappet 13, and by elastic seal 16 via pressure piston 15. Compensation chamber 17 is continually supplied with fuel as hydraulic fluid by way of a fuel inlet 19 and an inflow throttle 20. A negligible quantity of fuel is also drained continuously via a discharge throttle 21 und a fuel discharge 22.

Also via fuel inlet 19 and inflow bores 23*a*, 23*b* and 23*c*, fuel is flowing to sealing seat 6.

If actuator 11 is energized via connecting lines 14, it expands in length and attempts to press pressure piston 15 into compensation chamber 17. Since the fuel contained in compensation chamber 17 is only slightly compressible as a fluid and inflow throttle 20 and discharge throttle 21 have small diameters, such as 20 μm, only small quantities of fuel may escape, and high pressure is rapidly generated in compensation chamber 17 against which pressure piston 15 is braced. In this way, valve spring 9 at the other end of actuator 11 is acted on with an opening force, via actuator tappet 13, and valve needle 2 with valve-closure member 3 is actuated, so that valve-closure member 3 lifts off from sealing seat 6. Once the current has been switched off, valve spring 9 moves valve needle 2 back into its original position. At the same time, chamber spring 18 exerts a compressive force on pressure piston 15, which retains actuator 11 with actuator tappet 13 at spring stop 8 of valve needle 2. The spring forces adjust actuator 11 between the hydraulic cushion and the valve needle in a play-free manner. In the process, fuel continues to flow via inflow throttle 20 into compensation chamber 17 until it is completely filled with fuel again. If the heating causes linear deformations of valve body 4 or actuator 11, actuator 11 with actuator tappet 13 and pressure piston 15 will thus always be displaced in the longitudinal direction of fuel injector 1 until it comes to rest against spring stop 8 of valve needle 2.

Since fuel continually flows through compensation chamber 17, even during the rest phase of actuator 11 in which actuator 11 is not energized via connecting lines 14, this compensation chamber 17 is cooled. Furthermore, in an exemplary embodiment of the present invention no parts of a coupler are dynamically displaced in fuel injector 1, since compensation chamber 17 is only subjected to a static support force via pressure piston 15. The response characteristic of fuel injector 1 is thus improved. If fuel discharge 22 is arranged in such a way that an outlet 24 lies at the highest point in the installation position of fuel injector 1 of an internal combustion engine (not shown here), any possibly produced gas bubbles are effectively removed from compensation chamber 17. In particular, once a hot internal combustion engine has been turned off, this prevents that evaporated fuel in compensation chamber 17 forms a gas bubble during restarting, since such gas bubbles are removed via inflow throttle 20 and pushed into fuel discharge 2 when the fuel supply commences 2. It cannot happen that pressure piston 15 is unable to generate pressure in compensation chamber 17 due to compressed gas bubbles, and valve needle 2 thus fails to open.

Alternatively, it is possible to use a check valve instead of inflow throttle 20, which releases a large flow cross section when vacuum pressure exists in compensation chamber 17. Also as an alternative, a pressure limiting valve may be used instead of discharge throttle 21, which, due to its inertia, does not respond during the brief activation phase of actuator 11, but opens when a certain adjustable superpressure exists in compensation chamber 17 and releases a large discharge cross section.

Figure 2:
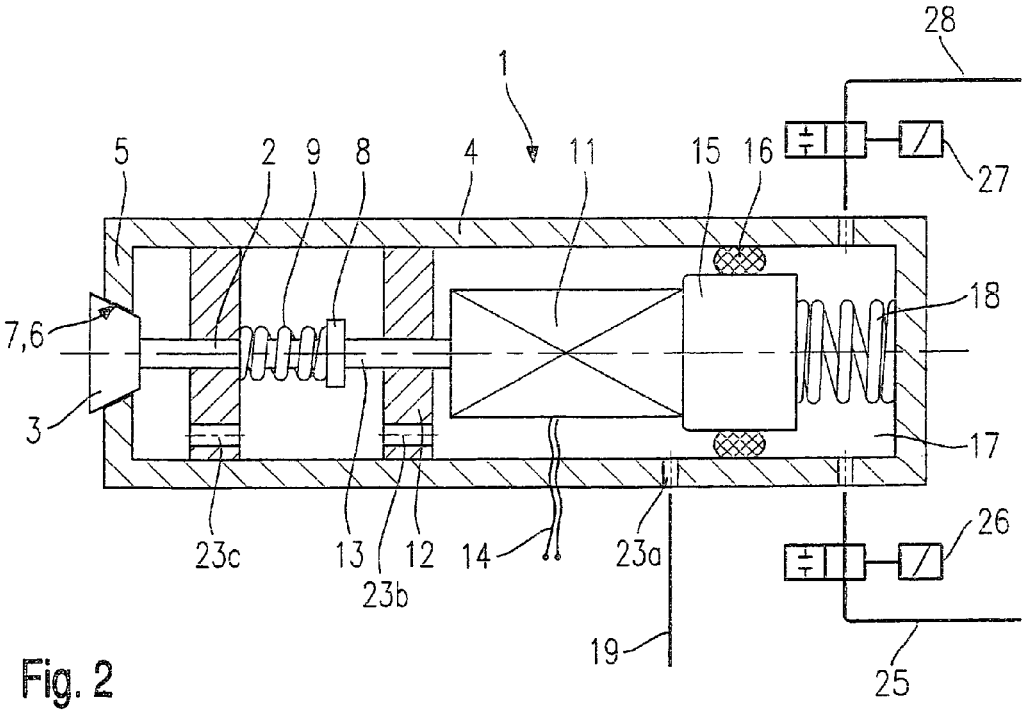
FIG. 2 shows a schematic section through a second exemplary embodiment of a fuel injector according to an exemplary embodiment of the present invention.

FIG. 2 shows an exemplary embodiment of a fuel injector 1 according to the present invention. Components that are identical to FIG. 1 have been provided with the same reference numerals. Valve-closure member 3 is in operative connection with valve needle 2, forming a sealing seat 6 together with valve sealing-seat surface 6 on valve-sealing section 5 formed on valve body 4. Via valve spring 9 and valve-spring stop 8, valve needle 2, which is guided in guide sleeve 10, is pulled into sealing seat 6 by way of its valve-closure member 3. Actuator 11 is arranged between actuator tappet 13, guided in partition disk 12, and pressure piston 15 held by elastic seal 16 and is interconnected to them and may be energized via connecting lines 14. Fuel is supplied to sealing seat 6 via fuel inlet 19 and supply bores 23*a*, 23*b* and 23*c*. Chamber spring 18 is arranged in compensation chamber 17.

Via an oil inlet 25, which has a switching valve 26 and is connected to the oil circuit of the internal combustion engine (not shown here), oil is supplied to compensation chamber 17 as hydraulic fluid. This oil can flow off via an additional switching valve 27 and an oil outlet 28.

Switching valves 26, 27 may release large flow cross sections. After actuator 11 is de-energized, switching valve 26 of oil inlet 25 allows a rapid refilling of the compensation chamber by a large inflow cross section. It is also possible, at the same time and controllable in the extent, to release oil outlet 28 by a switching valve 27, attaining a flushing and cooling of compensation chamber 17. In the same manner, it is possible to prevent the formation of bubbles, both after a start and during operation. This danger is additionally reduced by the use of the medium oil as the hydraulic fluid.

What is claimed is:

1. A fuel injector for a fuel-injection system of an internal combustion engine, comprising:

one of a piezoelectric actuator and a magnetostrictive actuator;

a valve needle;

a valve-closure member;

an actuator; and an hydraulic compensation chamber;

wherein the one of the piezoelectric actuator and magnetostrictive actuator, by way of the valve needle, actuate the valve-closure member arranged on the valve needle, the valve-closure member cooperating with a valve-seat surface to form a sealing seat, the hydraulic compensation chamber cooperating with a pressure piston and being filled with hydraulic fluid via an hydraulic fluid inlet, the actuator is arranged between the pressure piston and the valve needle and is displaceable in the axis of the valve needle and the pressure piston, and wherein a chamber spring is arranged on the side of the hydraulic compensation chamber of the pressure piston and acts on the pressure piston with a prestressing force that presses the pressure piston out of the compensation chamber.

2. The fuel injector of claim 1, wherein the chamber spring includes a membrane spring.

3. The fuel injector of claim 1, wherein the chamber spring includes a disk spring.

4. The fuel injector of claim 1, wherein the chamber spring includes a helical spring.

5. The fuel injector of claim 1, wherein the hydraulic fluid is supplied at a higher pressure than a pressure of fuel on a side of the actuator of the pressure piston.

6. The fuel injector of claim 1, wherein the hydraulic fluid inlet has an inflow throttle to allow only a small portion of a volume of the compensation chamber to flow back during actuation of the actuator.

7. The fuel injector of claim 1, wherein the hydraulic fluid inlet includes a check valve.

8. The fuel injector of claim 1, wherein the hydraulic fluid inlet includes a controllable intake valve.

9. The fuel injector of claim 8, wherein the controllable intake valve is closed in a non-actuated state.

10. The fuel injector of claim 1, wherein the compensation chamber includes an hydraulic fluid outlet with a discharge throttle.

11. The fuel injector of claim 10, wherein the hydraulic fluid outlet in the compensation chamber is arranged at a highest point in an installation position of the fuel injector.

12. The fuel injector of claim 1, wherein the compensation chamber includes an hydraulic fluid outlet with a controllable discharge valve.

13. The fuel injector of claim 12, wherein the controllable discharge valve is closed in a non-controlled state.

14. The fuel injector of claim 1, wherein the compensation chamber includes an hydraulic fluid outlet with a pressure limiting valve.

15. The fuel injector of claim 1, wherein the compensation chamber is filled with fuel.

16. The fuel injector of claim 1, wherein the compensation chamber is connected to an oil circuit of the internal combustion engine via the hydraulic fluid inlet.

* * * * *